US010183305B2

(12) United States Patent
Alluigi

(10) Patent No.: US 10,183,305 B2
(45) Date of Patent: Jan. 22, 2019

(54) DISPENSER HEAD FOR MANUAL LIQUID DISPENSER DEVICE

(71) Applicant: GUALA DISPENSING S.p.A., Alessandria (IT)

(72) Inventor: Riccardo Alluigi, Alessandria (IT)

(73) Assignee: GUALA DISPENSING S.P.A., Alessandria (IT)

( * ) Notice: Subject to any disclaimer, the term of this patent is extended or adjusted under 35 U.S.C. 154(b) by 0 days.

(21) Appl. No.: 14/908,894

(22) PCT Filed: Apr. 30, 2014

(86) PCT No.: PCT/IB2014/061114

§ 371 (c)(1),
(2) Date: Jan. 29, 2016

(87) PCT Pub. No.: WO2015/015326

PCT Pub. Date: Feb. 5, 2015

(65) Prior Publication Data

US 2016/0158780 A1 Jun. 9, 2016

(30) Foreign Application Priority Data

Jul. 31, 2013 (IT) ..... BS2013A0114

(51) Int. Cl.
*B05B 11/00* (2006.01)

(52) U.S. Cl.
CPC ..... *B05B 11/3057* (2013.01); *B05B 11/0064* (2013.01); *B05B 11/303* (2013.01);
(Continued)

(58) Field of Classification Search
CPC ..... B05B 11/3057; B05B 11/0064; B05B 11/3011; B05B 11/3016; B05B 11/3023;
(Continued)

(56) References Cited

U.S. PATENT DOCUMENTS 3,768,734 A * 10/1973 Anderson, Jr. ..... B05B 1/12 222/341
4,225,061 A * 9/1980 Blake ..... B05B 11/3032 222/207

(Continued)

FOREIGN PATENT DOCUMENTS

EP 1500436 A1 1/2005
WO 99/53388 A1 10/1999

(Continued)

OTHER PUBLICATIONS

Polyhedron Laboratories, Inc. Typical Properties of Polypropylene [online]. Polyhedron Laboratries, Inc., 2011 [retrieved on Apr. 30, 2017]. Retrieved from the Internet via web archive: <URL:https://web.archive.org/web/20110110092942/http://www.polyhedronlab.com/services/plastics-testing/polypropylene-testing.html>.*

(Continued)

*Primary Examiner* — Benjamin R Shaw
(74) *Attorney, Agent, or Firm* — Merhcant & Gould P.C.

(57) ABSTRACT

A dispenser head (10) of a trigger dispenser device includes a self-bearing pre-compression valve (80), made of polypropylene, capable of per se retaining in a stable manner to the head frame (14").

18 Claims, 10 Drawing Sheets

(52) U.S. Cl.
CPC ..... *B05B 11/3011* (2013.01); *B05B 11/3016* (2013.01); *B05B 11/3023* (2013.01); *B05B 11/3069* (2013.01); *B05B 11/3095* (2013.01); *B05B 11/007* (2013.01); *B05B 11/3035* (2013.01)

(58) Field of Classification Search
CPC ..... B05B 11/303; B05B 11/3069; B05B 11/3095; B05B 11/007; B05B 11/3035
USPC ..... 222/383.1, 321.2
See application file for complete search history.

(56) References Cited

U.S. PATENT DOCUMENTS 4,618,077 A * 10/1986 Corsette ..... B05B 11/0016 222/340
4,668,761 A * 5/1987 Aoshima ..... B29C 55/005 264/557
5,114,052 A * 5/1992 Tiramani ..... B05B 11/0016 222/207
5,779,108 A * 7/1998 Barriac ..... B05B 11/0016 222/340
5,884,820 A * 3/1999 Thanisch ..... B05B 11/007 222/335
6,123,236 A * 9/2000 Bloom ..... B05B 11/3011 222/341
6,234,361 B1 * 5/2001 Bloom ..... B05B 11/3011 222/1
2007/0131718 A1 * 6/2007 Bistolfi ..... B05B 11/0016 222/189.09
2009/0018267 A1 * 1/2009 Vestberg ..... C08F 110/06 525/52
2010/0155425 A1 * 6/2010 Alluigi ..... B05B 11/303 222/153.09
2012/0261438 A1 * 10/2012 Dejong ..... B05B 11/3011 222/383.1
2014/0031480 A1 * 1/2014 Kock ..... C08F 10/06 524/451

FOREIGN PATENT DOCUMENTS

WO 2008/116656 A1 10/2008
WO 2011/128786 A1 10/2011
WO 2011/128787 A1 10/2011
WO 2012/069939 A1 5/2012
WO 2012/110861 A1 8/2012
WO 2012/156830 A1 11/2012
WO 2012/172276 A1 12/2012
WO 2013/079418 A1 6/2013

OTHER PUBLICATIONS

"Integral" Merriam-Webster.com. Merriam-Webster, Oct. 2017.*
International Search Report for corresponding International Patent Application No. PCT/IB2014/061114 dated Jan. 10, 2014.

* cited by examiner

DISPENSER HEAD FOR MANUAL LIQUID DISPENSER DEVICE

This application is a National Stage Application of PCT/IB2014/061114, filed 30 Apr. 2014, which claims benefit of Serial No. BS2013A000114, filed 31 Jul. 2013 in Italy and which applications are incorporated herein by reference. To the extent appropriate, a claim of priority is made to each of the above disclosed applications.

BACKGROUND OF THE INVENTION

The object of the present invention is a manual trigger dispenser device, primarily for liquids, for example for the hygiene of the house, the deodorization of environments, the treatment of fabrics before ironing, and the like.

Such devices have experienced a huge spreading, as is evident by looking at the shelves of supermarkets, especially for their ease of use and functionality. Many hundreds of millions of pieces are produced every year.

One of the reasons of the great circulation of such devices is the ability to spread a small amount of liquid in a large volume of space or on a wide surface.

This ability is due to the fact that, before being dispensed, the liquid is put under pressure in a pressure chamber in which a piston actuated by the trigger slides; the connection of the pressure chamber towards the outlet is closed by a pre-compression valve. Once a pressure value that makes the pre-compression valve open has been exceeded, the liquid proceeds at high speed towards a nozzle, formed so as to produce a more or less dense cloud of droplets, according to the needs.

The pre-compression valve therefore has an essential role for the proper functioning of the device. It must be such as to enable the dispensing of the liquid only upon exceeding a minimum pressure for smooth operation, but also so as not to require an excessive effort for operating the trigger for the user.

One of the most significant problems related to the pre-compression valve is the assembly of the same to the other components of the dispenser head, in general to the frame. A moment before dispensing, a pressure of 10 bar can be reached in the pressure chamber, which is equivalent, for the usual dimensions of such devices, to an action of about 12 Kilograms on the valve. Retaining it to the frame must therefore be extremely effective, as a failure of the coupling would make the valve labile and therefore it would be impossible to achieve the desired pressure in the pressure chamber.

There are several solutions for the assembly of the pre-compression valve to the frame of the dispenser head.

For example, some solutions are described in US2012/261438A1, WO2013/079418A1, EP1500436A1, U.S. Pat. No. 5,114,052A, WO2012/172276A1, U.S. Pat. No. 4,225,061A, WO99/53388A1 and International Applications WO2012/069939, WO 2012/156830, WO 2012/110861, WO 2011/128787 and WO 2011/128786 by the Applicant. In these solutions, the pre-compression valve is kept in position by a locking element that engages the frame. These systems have proved effective but require an additional component for implementation.

Another known solution is described in International Application WO 2008/116656. In this solution, the pre-compression valve is held to the frame by a wall of the cover of the dispenser head, which compresses the valve sleeve inside the seat of the valve itself. While this solution is effective, it requires a careful implementation of the head cover and particular caution and care in the assembly of the cover to the frame.

SUMMARY OF THE INVENTION

The object of the present invention is to provide a manual trigger dispenser device provided with a pre-compression valve, which is able to meet the above requirements and overcome the drawbacks mentioned with reference to the prior art.

BRIEF DESCRIPTION OF THE DRAWINGS

The features and advantages of the trigger dispenser head according to the present invention will appear more clearly from the following description, made by way of an indicative and non-limiting example with reference to the annexed figures, wherein.

DETAILED DESCRIPTION OF THE PREFERRED EMBODIMENTS

Figure 1A:
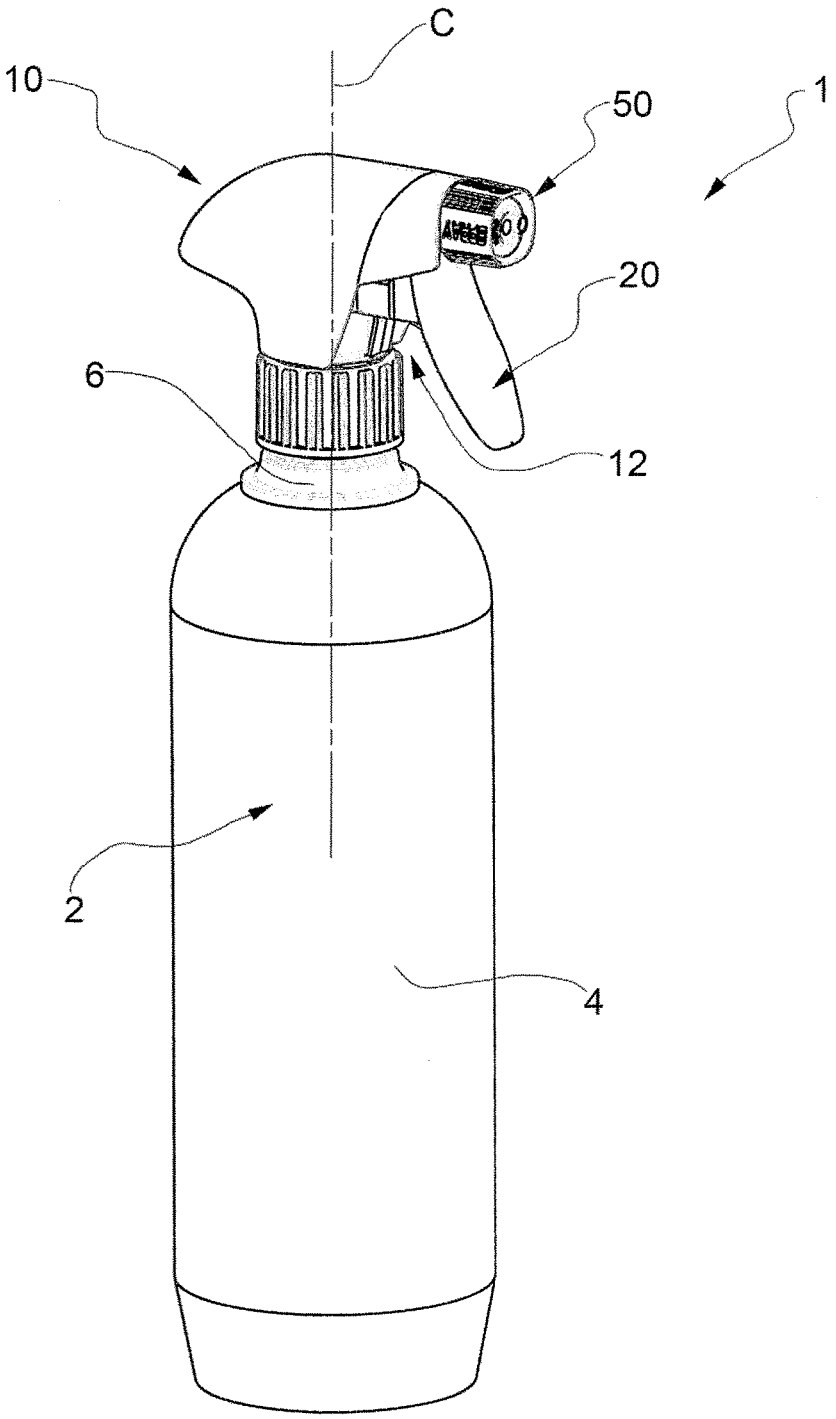
FIGS. 1*a* and 1*b* show two embodiment variants of a manual trigger dispenser device comprising a dispenser head according to the present invention.
Figure 1B:
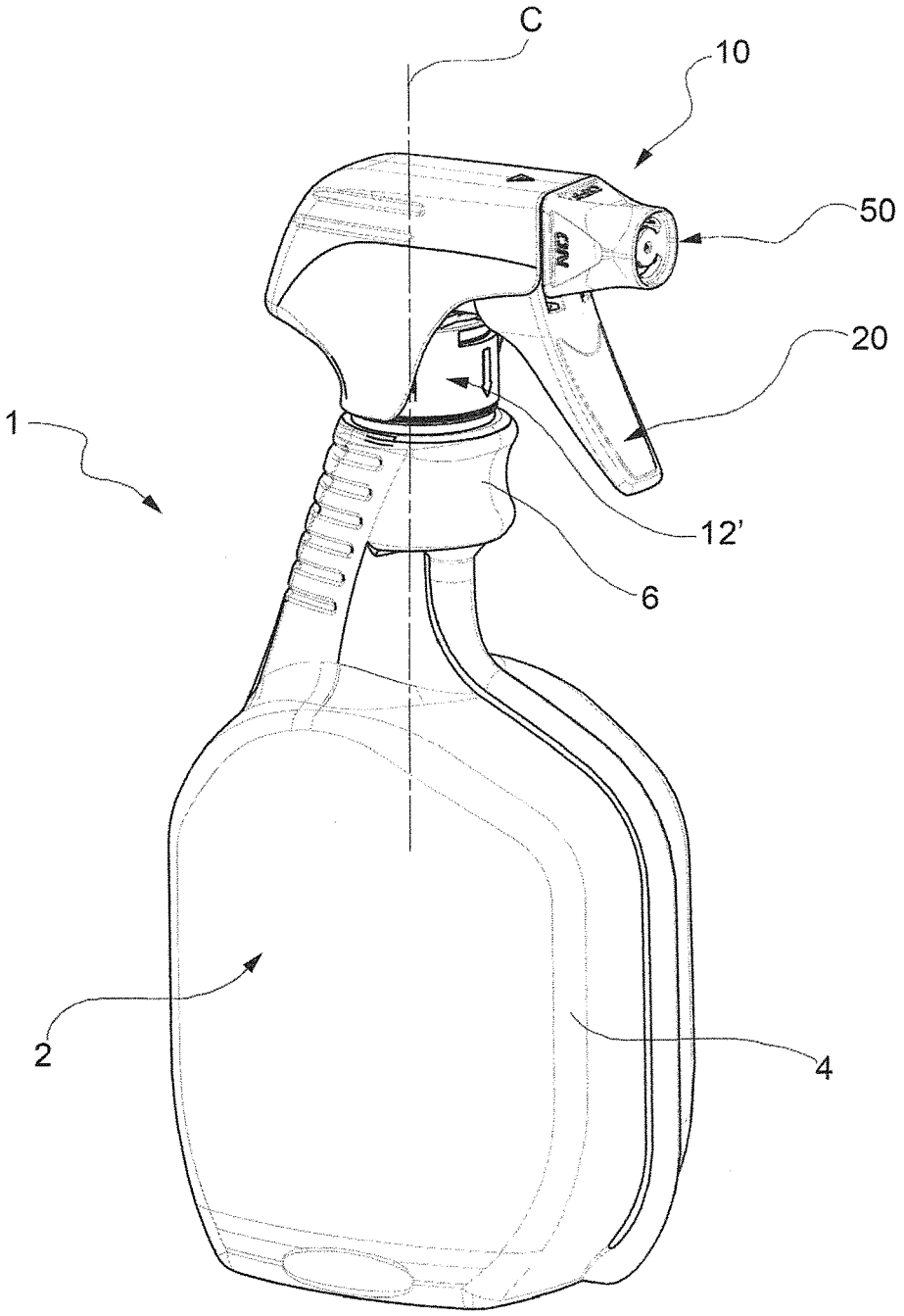

With reference to FIGS. 1*a* and 1*b*, reference numeral 1 generally indicates a manual trigger dispenser device. Device 1 comprises a container 2, for example a bottle, consisting of an annular side wall 4, and a neck 6, placed at the end of wall 4, having an aperture for accessing a compartment inside container 2. A neck axis C, central relative to aperture 6, is defined for neck 6.

Figure 2:
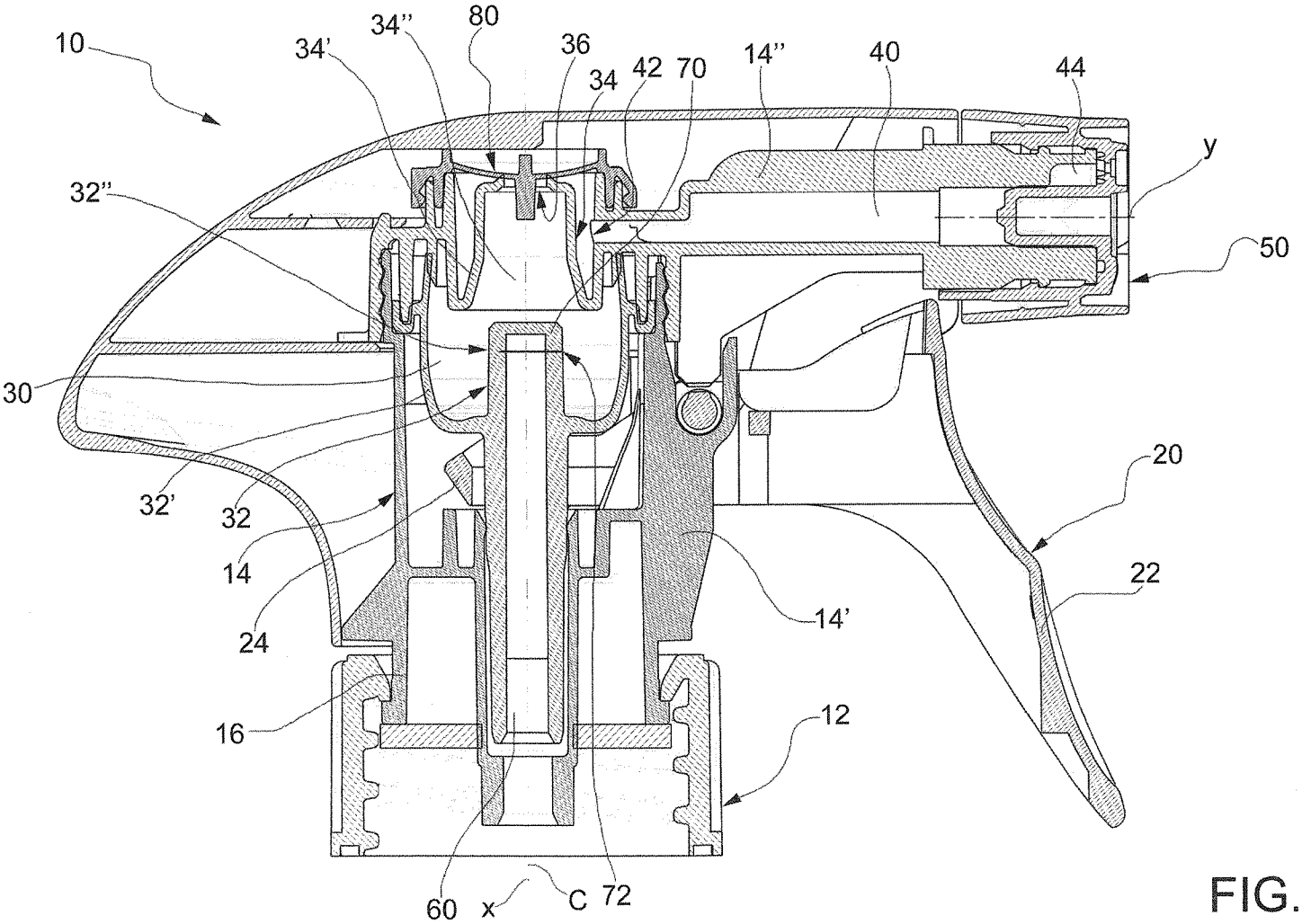
FIG. 2 shows a section of a dispenser head according to an embodiment of the present invention.

With reference to FIG. 2, device 1 also comprises a dispenser head 10, generally pre-assembled, mechanically applicable to container 2, and in particular applicable to neck 6.

For example, head 10 is applied via a threaded connection 12.

Head 10 comprises a frame 14, generally comprising a frame foot 16, shaped as an annular wall, connectable to the neck of container 2 through the threaded connection 12.

Head 2 further comprises a trigger 20 operable by translation or rotation in order to obtain the dispensing of the liquid. Trigger 20 is supported by frame 14, for example hinged thereto or guided in translation thereby. Preferably, trigger 20 includes a handle portion 22 adapted to be pressed by about a user, and an extension 24, generally integral with the handle portion 22.

Head 10 further comprises pumping means adapted to suck the liquid in the container and dispense said liquid outside by the activation of trigger 20.

Said pumping means comprise a pressure chamber 30 of variable volume, and a piston 32, movable for reducing the volume of the chamber, operable by trigger 20, and in particular engaged by extension 24 of trigger 20.

For example, piston 32 is movable along a piston axis X, coincident or parallel with the mouth axis C of neck 6 of the container.

For example, piston 32 consists of a deformable membrane 32' and possibly a head 32", which, under the action of the trigger, reduce the volume of the deformable pressure chamber 30.

The pressure chamber 30 is further delimited by an auxiliary body 34 comprising an active wall 34' which delimits a seating compartment 34" which, in a dispensing end configuration, receives head 32" of piston 32. The auxiliary body 34 is provided with a main aperture 36, delimited by an annular peripheral edge 36', projecting outwards of the pressure chamber 30.

Furthermore, head 10 comprises a dispenser duct 40 adapted to put the pressure chamber 30 in communication with the external environment. The dispenser duct 40 extends along a dispensing axis Y, preferably perpendicular or in any case incident to the piston axis X, between an input opening 42 and an opposite free end 44.

Between the input opening 42 of the dispenser duct 40 and the main aperture 36 of the pressure chamber 30, the head has an intermediate compartment which at least partially surrounds the pressure chamber 30, and in particular the active wall 34' of the auxiliary body 34.

Head 10 further comprises a nozzle 50, arranged at the free end 44 of the dispenser duct 40.

Preferably, frame 14 is made in two parts: a main frame body 14', which for example engages trigger 20, and a secondary frame body 14", wherein the dispenser duct 40 is formed and, for example, is united with the auxiliary body 34.

The main body of frame 14' is mechanically engaged, for example snap-engaged, with the secondary frame body 14", and membrane 32' of piston 32 is retained and locked therebetween and sealingly engaged with the secondary frame body 14".

The dispenser head 10 further comprises a suction duct 60 adapted to put the compartment inside the container in communication with the pressure chamber 30. For example, the suction duct 60 passes through head 32" of piston 32.

According to an embodiment (FIG. 1*a*), the suction duct 60 is coaxial with the neck axis C; according to a further embodiment (FIG. 1*b*), the suction duct (60) is offset relative to the neck axis (C).

In addition, head 2 includes check valve means arranged between the pressure chamber 30 and the suction duct 60, and adapted to switch from a closed configuration, in which they close the communication between the pressure chamber 30 and the suction duct 60, and an open configuration, in which they allow the communication between the pressure chamber 30 and the suction duct 60.

For example, said intake valve means include a lip 70 of head 32", and a partial cut 72 through such a head 32".

In addition, head 10 includes pre-compression check valve means sensitive to the pressure in the pressure chamber 30, arranged between the pressure chamber 30 and the dispenser duct 40, and adapted to switch from a closed configuration, in which they close the communication between the pressure chamber 30 and the dispenser duct 40, and an open configuration, in which they allow the communication between the pressure chamber 30 and the dispenser duct 40.

According to a preferred embodiment, the pre-compression means comprise a pre-compression valve 80 applied to the main aperture 36 of the pressure chamber 30; for example, the pre-compression valve 80 is made as a component separate from the secondary frame body 14" and applied thereto.

The pre-compression valve 80 includes a deformable membrane 82, in abutment with the peripheral projection 36' of the main aperture 36.

Membrane 82 preferably has an inner surface 82' facing towards the main aperture 36 and in contact with the peripheral edge 36', having a convex shape, and an opposite outer surface 82" having a concave shape.

Membrane 82 generally has a thickness between the inner surface 82' and the outer surface 82" which is thinner than the other portions of the pre-compression valve; said thickness is generally between 0.2 and 0.5 millimeters.

Preferably, the pre-compression valve 80 comprises, on the side of the inner surface 82', an annular sealing wall 90 that surrounds membrane 82 and axially protrudes therefrom, adapted to implement a seal with frame 14, and in particular with a sealing shoulder 92 of the secondary frame body 14".

The pre-compression valve 80 further comprises, on the side of the inner surface 82', an annular attachment wall 94 which surrounds membrane 82 and axially protrudes therefrom, for example arranged radially externally to the annular sealing wall 90.

Preferably, the attachment wall 94 is integral with membrane 82, of the same material as this.

The attachment wall 94 is adapted to snap-engage with the frame 14, and in particular with an attachment shoulder 96 of the secondary frame body 14".

In particular, the attachment wall 94 includes a radial attachment prominence 98, projecting internally, adapted to snap-engage with a similar prominence of the attachment shoulder 96, in turn projecting externally.

Preferably, moreover, the pre-compression valve 80 comprises an abutment element 100, projecting axially from membrane 82, on the side of the outer surface 82", adapted to abut with a fixed stop to limit the deformation of membrane 82.

Figure 3:
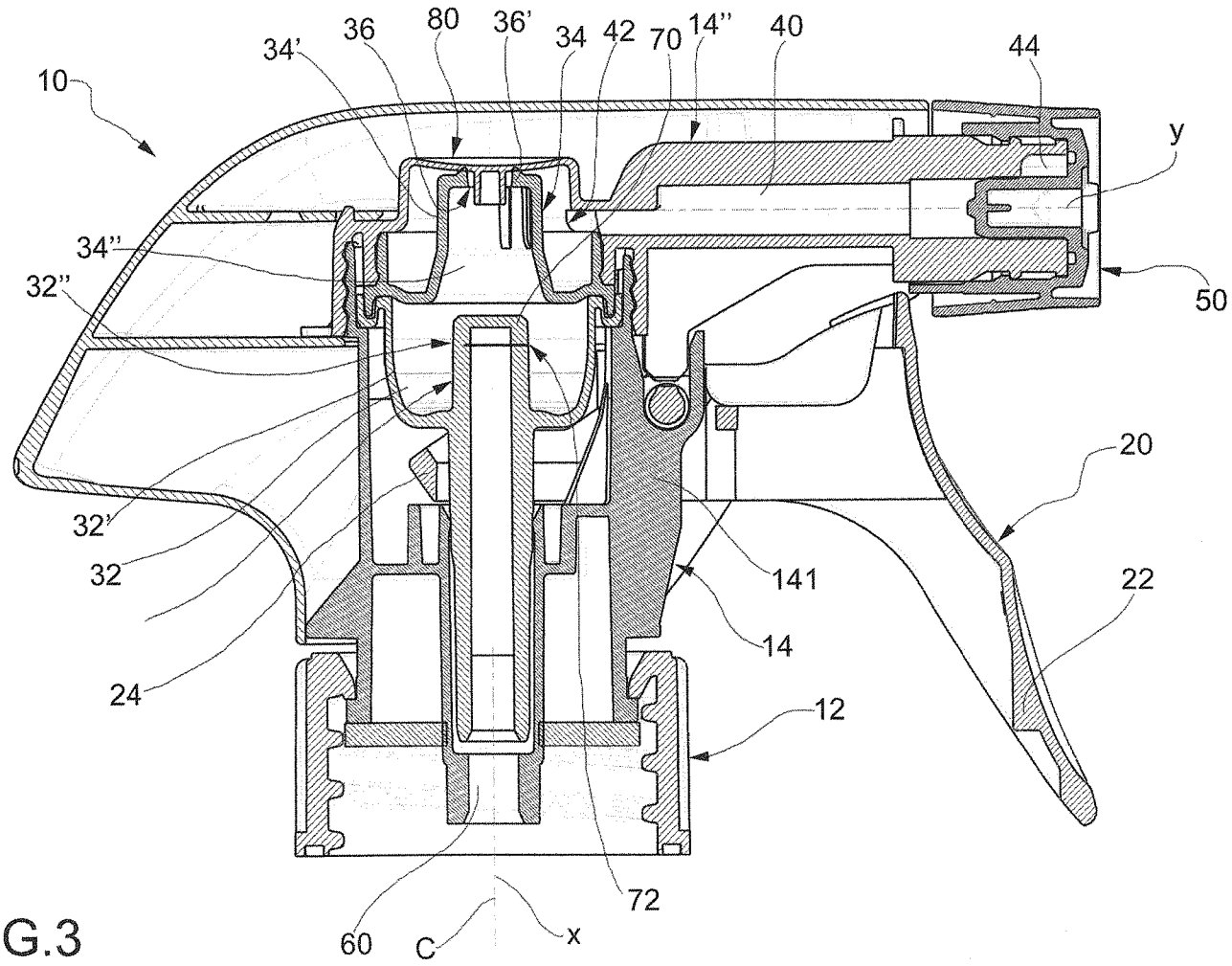
FIG. 3 shows a section of a dispenser head according to a further embodiment of the present invention.
Figure 3A:
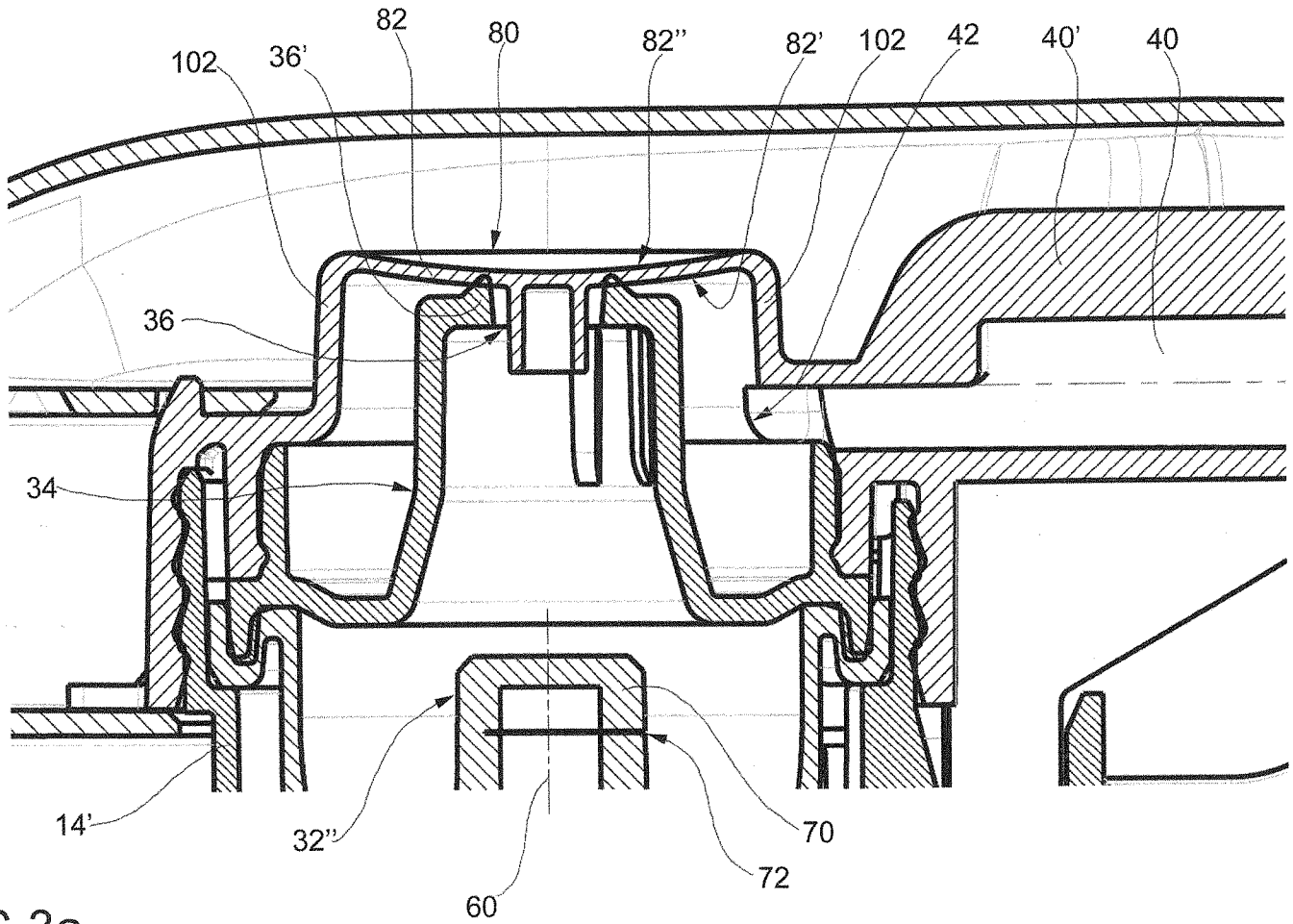
FIG. 3*a* shows an enlarged view of a pre-compressive valve of the head in FIG. 3.

According to a further embodiment, for example shown in FIGS. 3 and 3*a*, the pre-compression means comprise the pre-compression valve 80 applied to the main aperture 36 of the pressure chamber 30, in one piece with frame 14, and in particular in one piece with the secondary frame body 14", for example of the same material as said secondary frame body 14".

Preferably, the pre-compression valve 80 comprises, on the side of the inner surface 82', an annular joining wall 102 which surrounds membrane 82 and axially protrudes therefrom.

For example, on one side, the joining wall 102 is connected to a duct wall 40' which delimits the dispenser duct 40.

Also preferably, the joining wall 102, for example on the side opposite to that joined to the duct wall 40', mechanically snap-engages with the auxiliary body 34 and/or with the main frame body 14' to implement the mechanical connection therewith.

Figure 4:
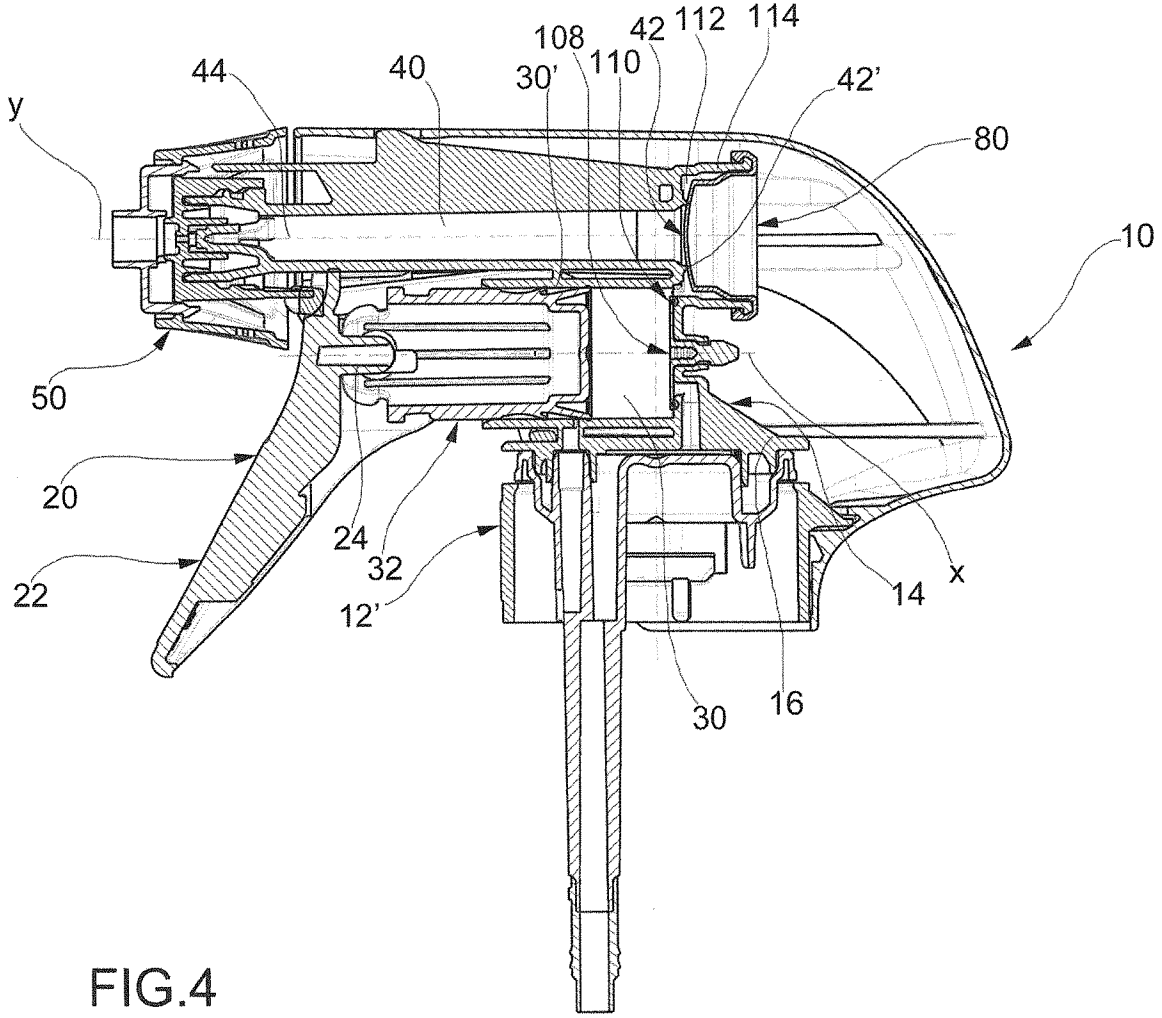
FIG. 4 shows a section of a dispenser head not part of the present invention.
Figure 4A:
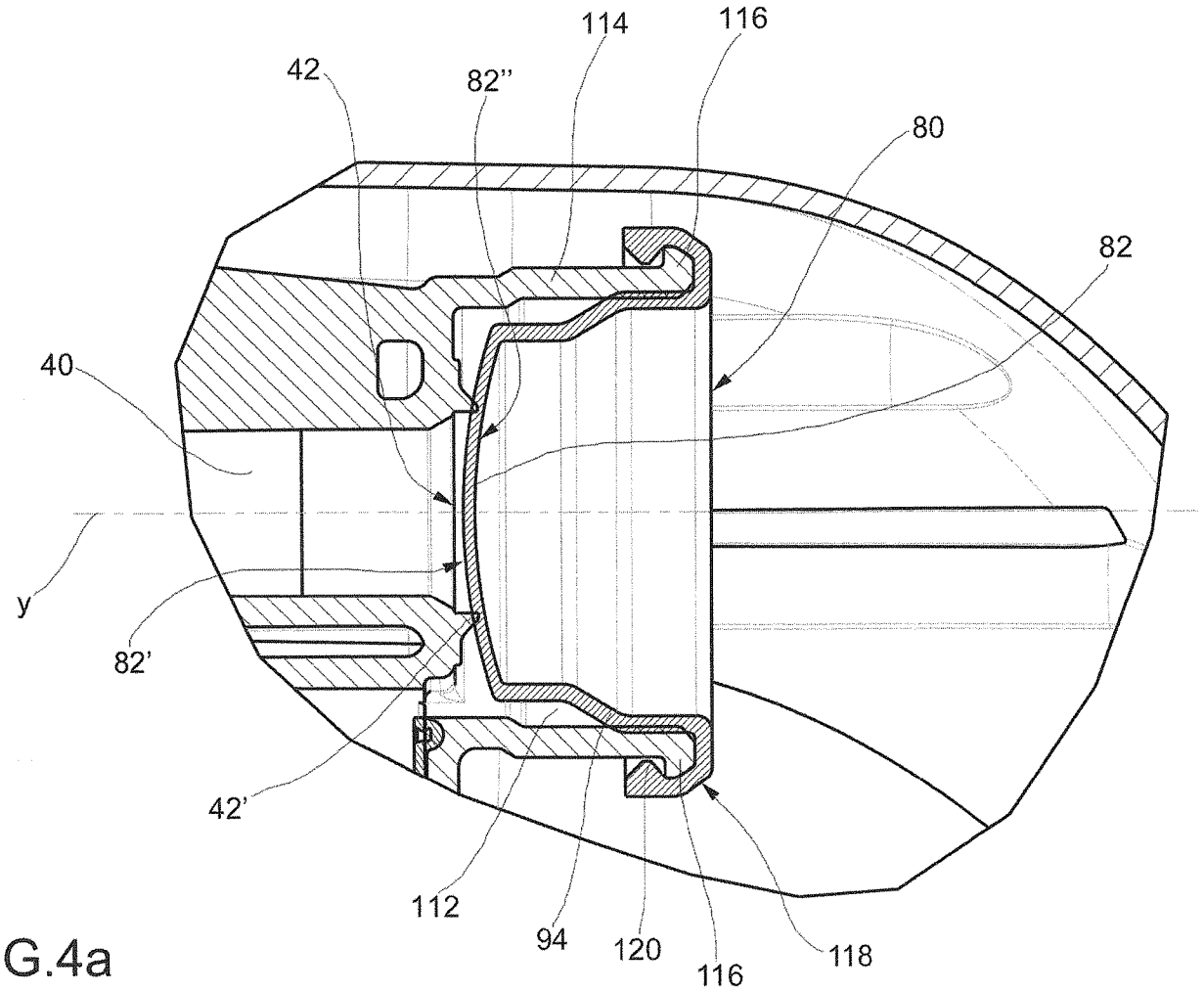
FIG. 4*a* shows an enlarged view of a pre-compressive valve of the head in FIG. 4.

According to a further embodiment not part of the present invention, for example shown in FIGS. 4 and 4*a*, the dispenser head 10 is connectable to the container by a bayonet connection 12'.

The pressure chamber 30 is rigid, i.e. delimited by a chamber wall 30' not deformable by the action of piston 32, sealingly slidable in said pressure chamber 30.

For example, the pressure chamber 30 is formed inside the frame 14.

Preferably, moreover, the piston axis X is parallel to the dispenser axis Y which identifies the extension direction of the dispenser duct 40, between the free end 44, to which nozzle 50 is applied, and the input opening 42, preferably delimited by an input projection 42' axially projecting towards the outside of the dispenser duct 40.

Preferably, the intake valve means include a flat intake valve 108, arranged placed on the bottom of the pressure chamber 30.

The pressure chamber 30 is also open on the bottom by an output opening 110 and between the output opening 110 and the input opening 42, the frame 14 has a valve seat 112 peripherally delimited by an annular seat wall 114.

Preferably, the seat wall 114 includes a coupling prominence 116, projecting radially externally with respect to the valve seat 112.

The pre-compression valve 80 is housed in said valve seat 112 and the membrane 82 engages, in the closed configuration, the input opening 42 of the dispenser duct 40, for example in abutment with the input prominence 42'.

The attachment wall 94 extends from the membrane 82, on the side opposite to the input opening 42 and includes an annular cuff 118, comprising an annular attachment protuberance 120, snap-engaged with the attachment prominence 116 of the seat wall 114.

In other words, according to the embodiments disclosed, the pre-compression valve comprises integrated retaining means per se adapted to stably retaining valve 80 to frame 14, i.e. adapted per se to withstand the action of extraction from the frame exerted by the liquid during the dispensing step.

Figure 2A:
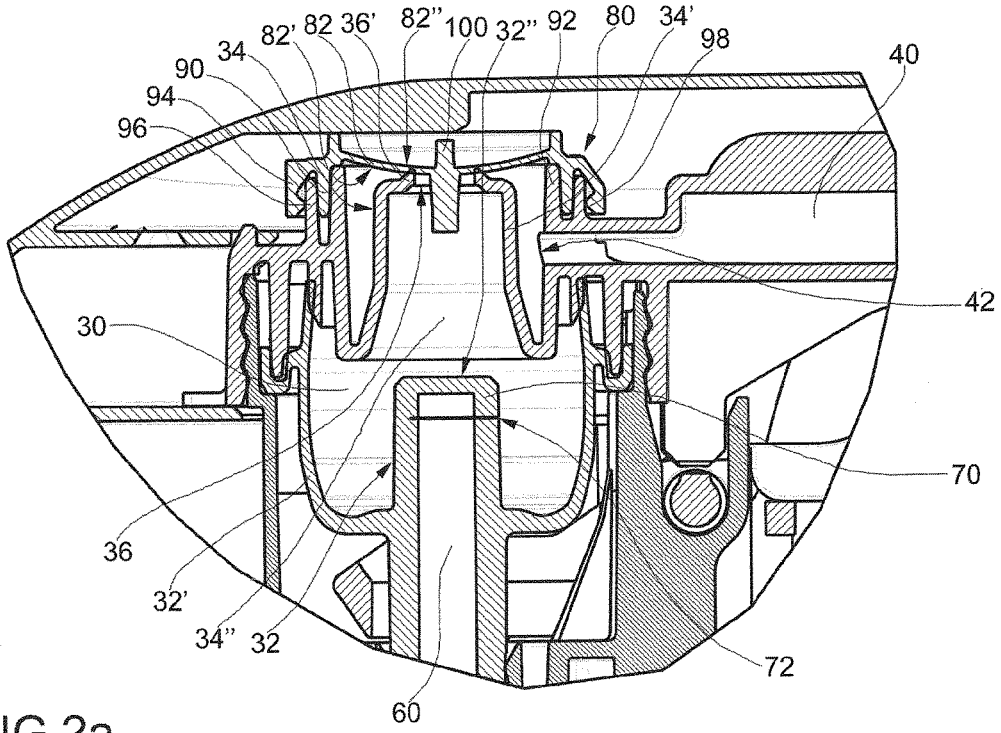
FIG. 2*a* shows an enlarged view of a pre-compressive valve of the head in FIG. 2.

Said retaining means comprise the attachment wall 94 (FIGS. 2*a* and 4*a*) or joining wall 102 (FIG. 3*a*).

In particular, said retaining means are made of a rigid plastic material, such as to enable the stable coupling of the pre-compression valve 80 to frame 14.

For example, the material of the retaining means has a bending flexural modulus (Flexural Modulus, ISO 178 "Plastics: Determination of flexural properties"), greater than 700 MPa, preferably greater than 900 Mpa, preferably greater than 1100 MPa, preferably equal to 1300 MPa.

According to a further example, the material of the retaining means has a tensile elasticity (Tensile Modulus, according to ISO 527-1 and 527-2, "Plastics: Determination of tensile properties"), greater than 1500 MPa, preferably greater than 1800 Mpa, preferably equal to 2000 MPa or equal to 2200 MPa.

For example, the material of the retaining means is polypropylene (PP).

The retaining means and membrane 82 are made in one piece, in the same rigid plastic material and the material of the retaining means is sufficiently rigid to ensure the stable attachment of the pre-compression valve 80 to frame 14 against the action of extraction of the liquid in the dispensing step, but soft enough to ensure the deformation of the membrane to allow the passage of the liquid towards the dispenser duct 40 during said dispensing step.

Figure 5:
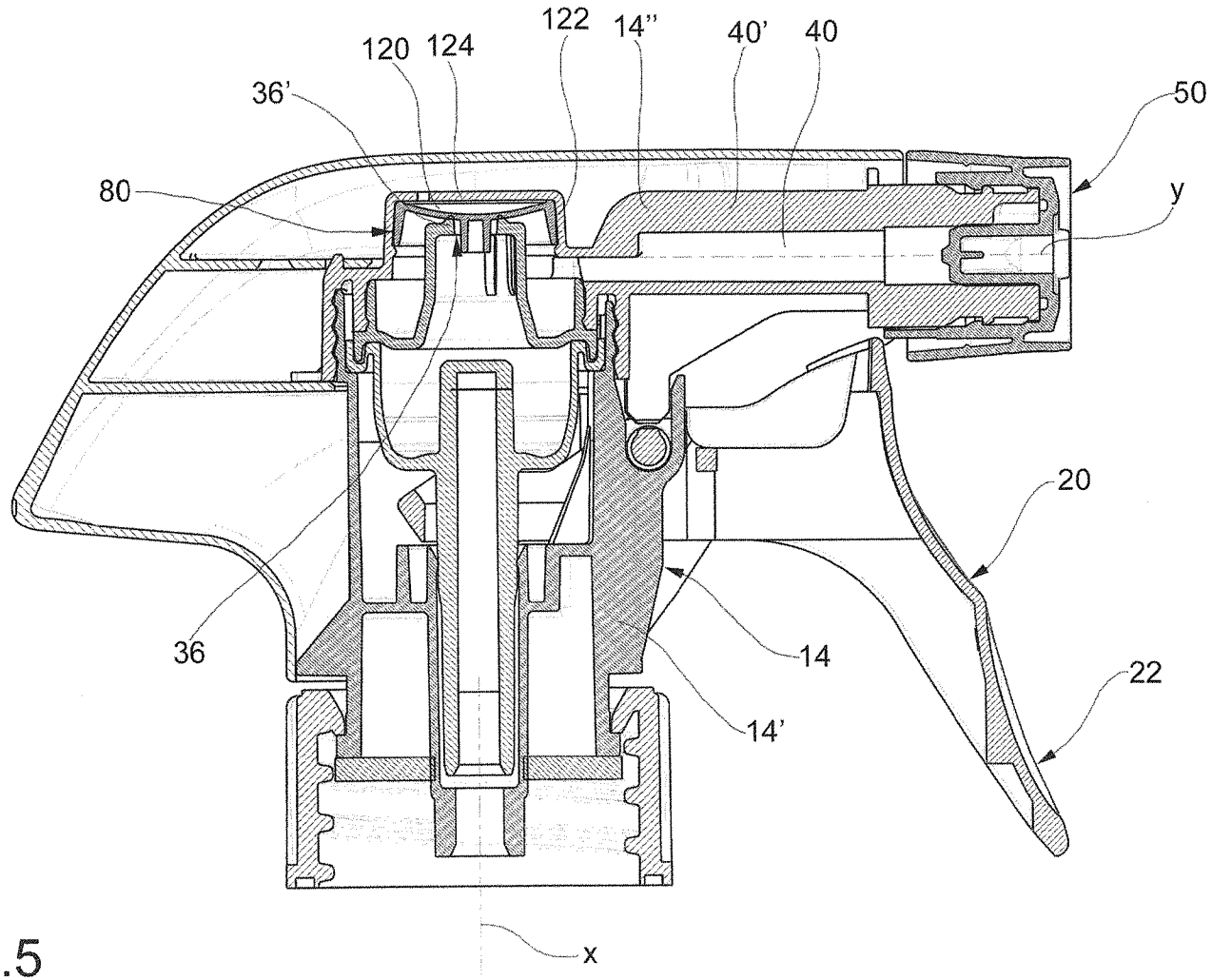
FIG. 5 shows an enlarged view of a pre-compression valve of the head in FIG. 4.
Figure 5A:
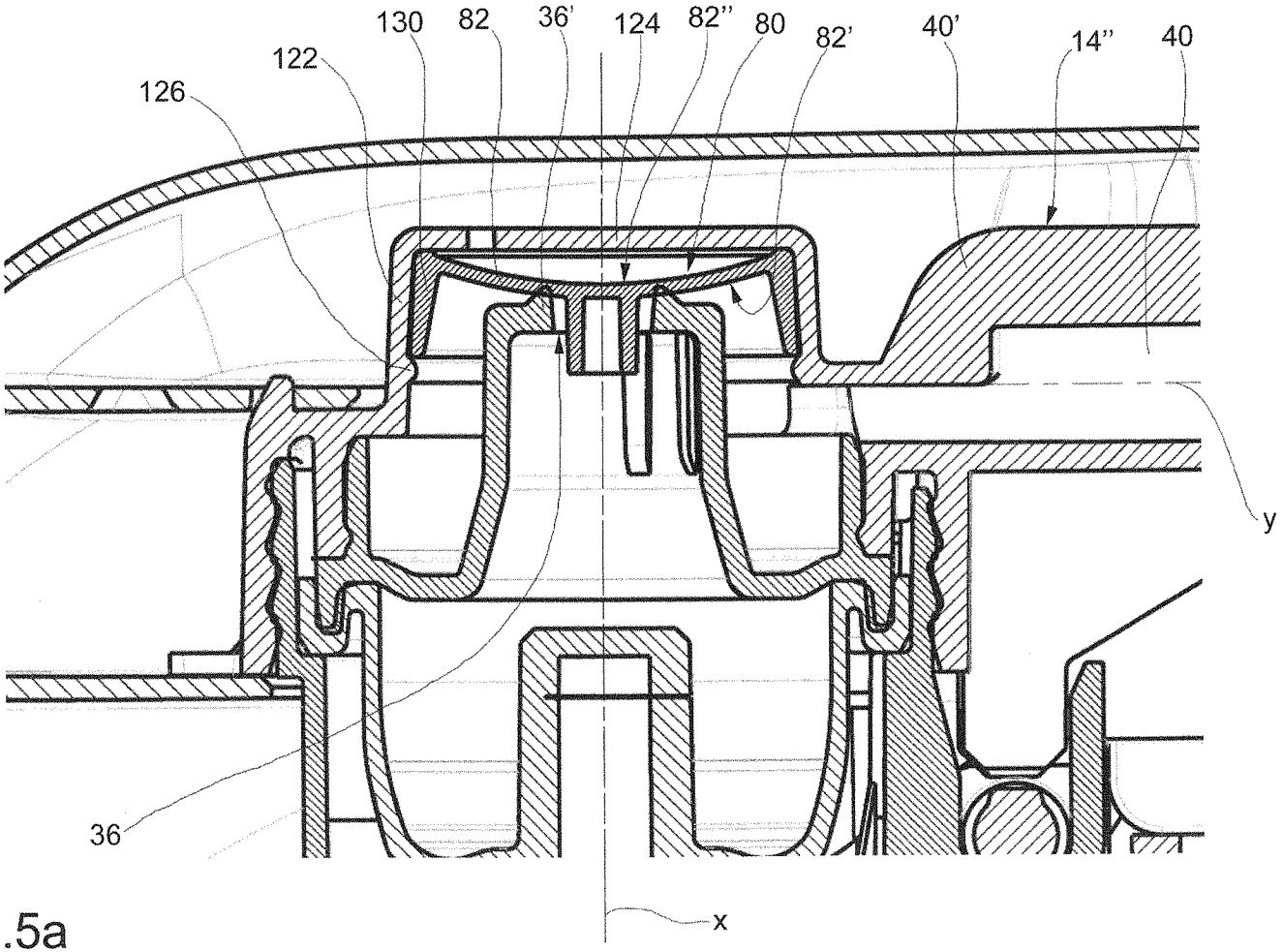
FIG. 5*a* shows an enlarged view of a pre-compressive valve of the head in FIG. 5.

According to a further embodiment, for example shown in FIGS. 5 and 5*a*, the dispenser head 10 incorporates the general structure and functionality of the variants described in FIGS. 2, 2*a*, 3 and 3*a*, but frame 14, and in particular the secondary frame body 14", has a valve seat 120 which faces the main aperture 36 of the pressure chamber 30, peripherally delimited by a seat wall 122 and a bottom 124, in one piece with the secondary frame body 14". The seat wall 122 includes an annular prominence 126 having a radial extension, arranged at a predefined axial distance from bottom 124.

The pre-compression valve 80 is accommodated in the valve seat 120 and includes membrane 82 which, in the closed configuration, closes the main aperture 36, for example arranging in abutment with the peripheral edge 36' of the main aperture 36.

The pre-compression valve 80 comprises an annular sleeve 130 which surrounds membrane 82 and is arranged peripherally to the valve seat 120, retained in the valve seat 120 by the annular prominence 126.

Innovatively, the dispenser device described above achieves the object mentioned since it allows simplifying the system for connecting the pre-compression valve to the frame, while meeting the functionality needs.

It is clear that a man skilled in the art could make changes to the device described above in order to meet incidental needs, all falling within the scope of protection defined in the following claims.

The invention claimed is:

1. Dispenser head of a manual dispenser device for a liquid, comprising:

a frame releasably connected to a container of the device;

a trigger supported by the frame;

a pump operated by the trigger to dispense the liquid, comprising a pressure chamber and a piston;

a dispenser duct made in the frame, connectable, at one end, to the pressure chamber and, at an other end, with the outside environment;

a pre-compression valve sensitive to compression of the liquid in the pressure chamber, positioned between the pressure chamber and the dispenser duct, switching, upon starting a dispensing step of the liquid, from a closed configuration, preventing transit of the liquid from the pressure chamber to the dispenser duct, to an open configuration, in which said transit is permitted;

wherein said pre-compression valve comprises an integrated retainer, made in a sufficiently rigid material suitable for retaining the pre-compression valve to the frame in a stable manner, overcoming action of the liquid in the dispensing step, wherein the pre-compression valve comprises a membrane positioned, in the closed configuration, to close a main aperture of the pressure chamber, said membrane being in one piece with said retainer and having an inner surface with a convex shape facing towards the main aperture and an outer surface with a concave shape;

wherein the dispenser duct extends along a dispenser axis and the piston, operated by the trigger, is translatable along a piston axis perpendicular or incident to the dispenser axis;

wherein the membrane flexes along an axis perpendicular or incident to the dispenser axis; and wherein the pre-compression valve is releasably connected to the frame and the retainer comprises an annular attachment wall of the pre-compression valve suitable to snap-engage with the frame, said attachment wall comprising a radial attachment prominence, projecting inwards, for snap-engagement with the frame.

2. Dispenser head according to claim 1, wherein the membrane has a thinner thickness than other portions of the pre-compression valve, the thickness of the membrane being between 0.2 and 0.5 millimeters.

3. Dispenser head according to claim 1, wherein the material of the retainer has a flexural modulus greater than 700 MPa.

4. Dispenser head according to claim 1, wherein the material of the retainer has a tensile modulus greater than 1500 MPa.

5. Dispenser head according to claim 1, wherein the material of the retainer is polypropylene.

6. Dispenser head according to claim 1, wherein the pre-compression valve is in one piece with the frame having a same material as the frame.

7. Dispenser head according to claim 6, wherein the frame is made in separable parts: a main frame body and a secondary frame body wherein the dispenser duct is made.

8. Dispenser head according to claim 7, wherein the trigger is engaged with the main frame body.

9. Dispenser head according to claim 7, wherein the pre-compression valve comprises a joining wall, connected to a duct wall which defines the dispenser duct and mechanically snap-engages the main frame body.

10. Trigger-operated manual dispenser device comprising a container and a dispenser head made according to claim 1, connectable to said container by a threaded or bayonet connection.

11. Dispenser head according to claim 1, wherein the material of the retainer has a flexural modulus greater than 900 MPa.

12. Dispenser head according to claim 1, wherein the material of the retainer has a flexural modulus greater than 1100 Mpa.

13. Dispenser head according to claim 1, wherein the material of the retainer has a flexural modulus of 1300 Mpa.

14. Dispenser head according to claim 1, wherein the material of the retainer has a tensile modulus greater than 1500 MPa.

15. Dispenser head according to claim 1, wherein the material of the retainer has a tensile modulus greater than 1800 MPa.

16. Dispenser head according to claim 1, wherein the material of the retainer has a tensile modulus of 2000 MPa.

17. Dispenser head according to claim 1, wherein the material of the retainer has a tensile modulus of 2200 MPa.

18. Dispenser head according to claim 1, wherein the pre-compression valve and integrated retainer comprise one piece formed of a plastic material having a tensile modulus and a flexural modulus so that the material is sufficiently rigid to provide stable attachment of the pre-compression valve to the frame and sufficiently soft to provide deformation of the membrane to allow passage of liquid toward the dispenser duct.

* * * * *